US006309104B1

(12) United States Patent
Koch et al.

(10) Patent No.: US 6,309,104 B1
(45) **Date of Patent: *Oct. 30, 2001**

(54) BAG-TYPE PACKAGE TO BE TORN FOR EASY ACCESS TO THE PRODUCT

(75) Inventors: Reinhard Koch, Sinzig; Horst Schaefer, Krunkel, both of (DE)

(73) Assignee: Lohmann GmbH & Co. KG, Neuwied (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/242,836

(22) PCT Filed: Aug. 13, 1997

(86) PCT No.: PCT/EP97/04391

§ 371 Date: Aug. 31, 1999

§ 102(e) Date: Aug. 31, 1999

(87) PCT Pub. No.: WO98/09594

PCT Pub. Date: Mar. 12, 1998

(30) Foreign Application Priority Data

Sep. 6, 1996 (DE) ..... 196 36 144

(51) Int. Cl.[7] ..... B65D 65/24; B65D 33/00
(52) U.S. Cl. ..... 383/200; 206/484; 383/9
(58) Field of Search ..... 383/200, 9; 206/484

(56) References Cited

U.S. PATENT DOCUMENTS

| | | | | |
|---|---|---|---|---|
| 3,154,238 | * | 10/1964 | Barnhill | 383/9 |
| 3,615,711 | * | 10/1971 | Markus et al. | 383/200 |
| 3,663,239 | * | 5/1972 | Rowe et al. | 206/484 |
| 3,741,778 | * | 6/1973 | Rowe | 383/200 |
| 4,141,452 | | 2/1979 | Martin et al. | 211/60 T |
| 4,332,327 | * | 6/1982 | Frohwerk et al. | 206/484 |
| 4,537,308 | * | 8/1985 | Hollander, Jr. | 206/484 |
| 4,696,404 | * | 9/1987 | Corella | 383/200 |
| 4,832,188 | * | 5/1989 | Christie | 206/162 |
| 5,062,716 | * | 11/1991 | Conrad et al. | 383/9 |
| 5,164,178 | * | 11/1992 | Muysson | 206/484 |
| 5,454,601 | * | 10/1995 | Sekine et al. | 383/200 |
| 5,826,985 | * | 10/1998 | Goodman et al. | 383/200 |
| 5,908,245 | * | 6/1999 | Bost et al. | 383/9 |

FOREIGN PATENT DOCUMENTS

| | | | | |
|---|---|---|---|---|
| 0 522 824 A1 | | 7/1902 | (EP) . | |
| 387271 | * | 2/1933 | (GB) | 383/200 |
| WO 94/28837 | | 12/1994 | (WO) . | |

* cited by examiner

*Primary Examiner*—Stephen P. Garbe

(57) ABSTRACT

A sachet-shaped tear-open package for rapid access to a packaged product, having at least one sealed seam with a weakening in the form of a notch or groove as a tearing aid, whereby the weakening has an additional gripping and opening aid in the form of at least one punch-out, aperture, embodied next to the weakening, is characterized in that a rim of the punch-out has an at least partially serrated contour.

20 Claims, 3 Drawing Sheets

BAG-TYPE PACKAGE TO BE TORN FOR EASY ACCESS TO THE PRODUCT

FIELD OF THE INVENTION

The invention relates to a sachet-shaped tear-open package for rapid access to a packaged product.

BACKGROUND OF THE INVENTION

A multitude of packaging forms such as three- or four-side sealed bags, tubular bags, satchel bags and flat-bottom bags are known which are produced of various materials, e.g. mono-materials or composite materials, and made media impermeable by means of gluing, sealing or welding.

The packaging materials employed for these packages generally are made of composite materials, which have an object of hermetically shielding the product and especially of preventing the permeation of vapor and gases. However, these characteristics also result in a higher strength of the packaging material, so that these composite materials are very difficult to tear and can only be torn under exertion of a relatively high force.

Thus, cutting tools such as scissors, knives or cutters, which are often disadvantageously not present on the spot, are often necessary for opening these packages. On the other hand, auxiliary constructions such as notches, grooves or serrations can reduce the above mentioned difficulties, but cannot satisfactorily eliminate them.

In certain fields of application, e.g. medicine, the above described packages must be opened with gloves, which often have slippery product residue adhering to them, so that a holding strength of the fingers does not suffice even for tearing open notches, and the fingers slide off.

An improvement of this situation is described in French Pat. No. 741.988. A tear spot has a notch provided in a sealed edge of a known package which is flanked on each side by a grip hole. This does improve gripping capacity of the tear spot, but it still leaves much to be desired in the case of gloved fingers and a slippery coating on the gloves.

WO 94/28837 describes a different solution for this problem, in which the fingers are prevented from slipping off by creating a coarse surface in the opening area of the package. For this, however, it is necessary to incorporate additional foreign materials, which on the one hand leads to increased costs and on the other hand makes a recycling of the package more difficult or even impossible.

SUMMARY OF THE INVENTION

On the basis of this state of the art, it is an object of the present invention to improve and further embody a package of a tear open type indicated to overcome the difficulties and technical limits indicated above and especially to enable a safe and quick tearing-open of the package for a rapid access to a packaged product without use of auxiliary means such as knives or scissors.

The object is achieved according to the invention in a package of the type described above in that contours of punch-outs, apertures, formed by punching, in the vicinity of a notch or groove in a sealed area are at least partially serrated.

The choice of a serrated contour of the punch-outs very advantageously and in a very uncomplicated and economically favorable way provides for secure contact by the fingers when gripping the sealed seam or seams with the fingertips and reliably prevents a gliding-off of the fingertips, so that the package can be torn open safely and quickly without auxiliary means such as knives or scissors.

At least one punch-out is provided according to the invention; however, two punch-outs can also preferably be provided on the right and left sides of the weakening.

Embodiments of the invention include at least one punch out assigned to a notch or groove in a sealed seam or in an area of overlap of sealed seams, according to the following examples.

If, e.g., a package has a longitudinal seam in addition to a cross-seam, the equipment can be provided in the area where the cross-seam and the longitudinal seam overlap.

If a punch-out with a closed punch line is chosen, this results in an open perforation of the sealed seam. If the punch line is not closed, the punch-out remains at the punched site and can be moved from the punching plane in a hinged manner, through which the function of a gripping and opening aid is also fulfilled. The punch-out is preferably circular, but it can also be polygonal or strip-shaped.

The punch-out preferably has a size which enables the introduction of a human finger. Its size should at least correspond to the tactile surface of a human fingertip.

In all cases, the contour of the punch-out is at least partially serrated, through which a significant improvement of the gripping and opening aid is achieved. The effect can be increased by bending the serration out of the punching plane and thus creating a considerably stronger slipping inhibitor.

Further details and advantages of the invention become evident in the following description of an embodiment example shown in the attached drawings.

DETAILED DESCRIPTION OF THE DRAWINGS

Figure 1:
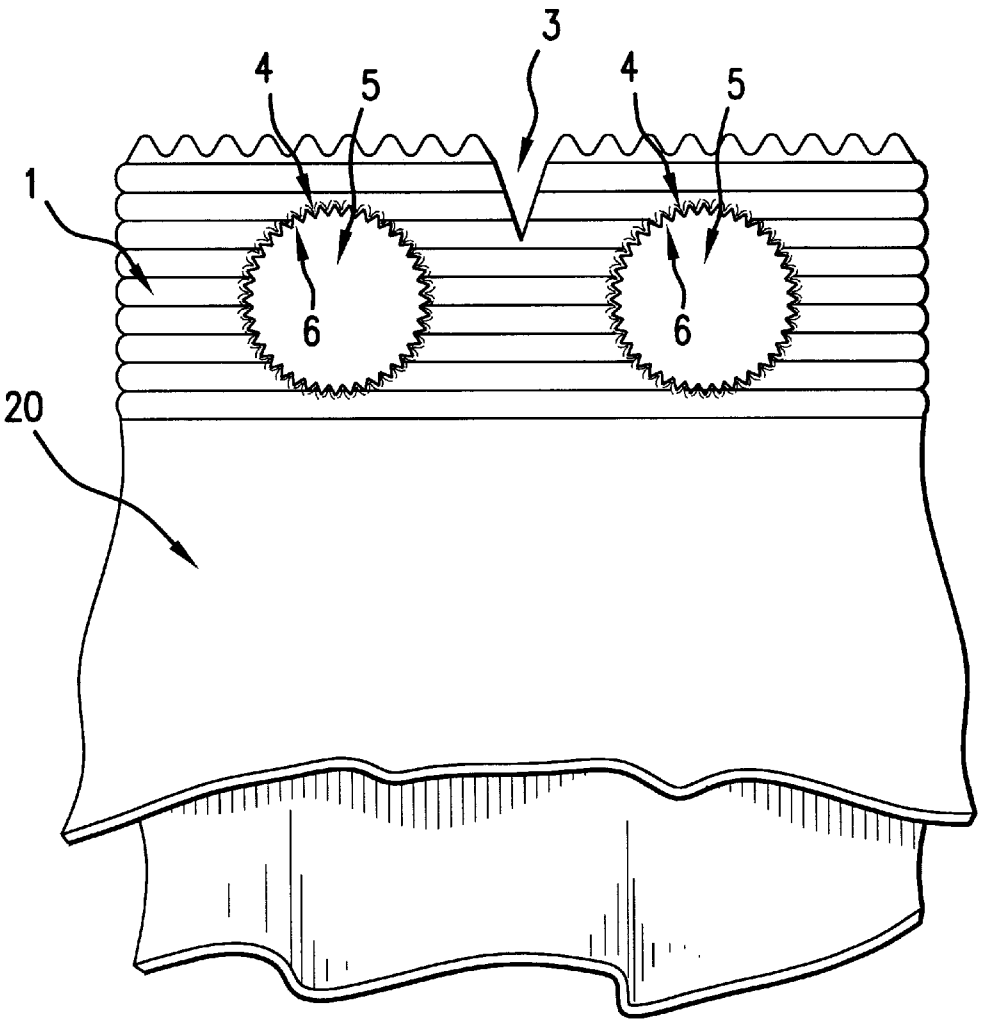
FIG. 1 shows a view of a part of a sachet-shaped package with a sealed cross-seam and a notch as well as two punch-outs next to the notch.

An embodiment example according to FIG. 1 shows a section of a sachet-shaped, bag type, tear-open package 20 with a sealed cross-seam 1 arranged in its transverse side. The sealed cross-seam has a notch 3 as tearing aid. Punch-outs, apertures, 5 are provided at both sides of this notch 3 as additional gripping and opening aids. Embodied according to the invention, a plurality of rims 4 of these punch-outs have an at least partially serrated contour 6. Unlike embodiments with smooth rims, this leads, in a very uncomplicated and economically favorable way, to a considerable improvement of the slipping resistance and a secure contact of the fingers when the package is gripped, and a gliding-off of the fingertips is prevented, so that the package 20 can be torn open safely and quickly without auxiliary means such as knives or scissors. Thus, a packaged product 10 is immediately exposed and can be removed.

Figure 2:
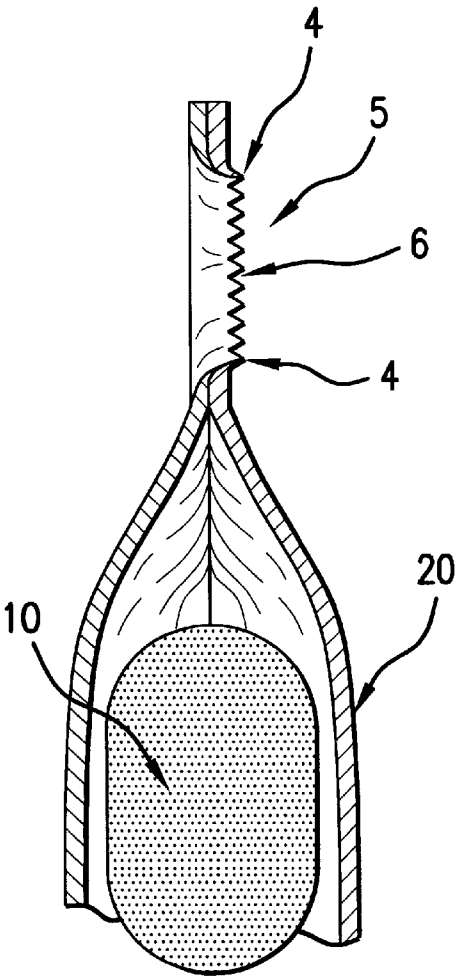
FIG. 2 shows a cross-sectional view of the area of the punch-out along the sectional plane II—II in FIG. 3.

FIG. 2 shows a side view of the torn-open packaging bag 20 with the packaged material 10 contained therein in a state ready to be removed. The punch-out 5, and a rim 4 of the plurality of rims of which is embodied with a serrated contour 6, can be seen in cross-sectional view. The serrated contour is at least partially bent out of the plane of the sealed border seam 1 in a way that makes it especially easy to grip.

Figure 3:
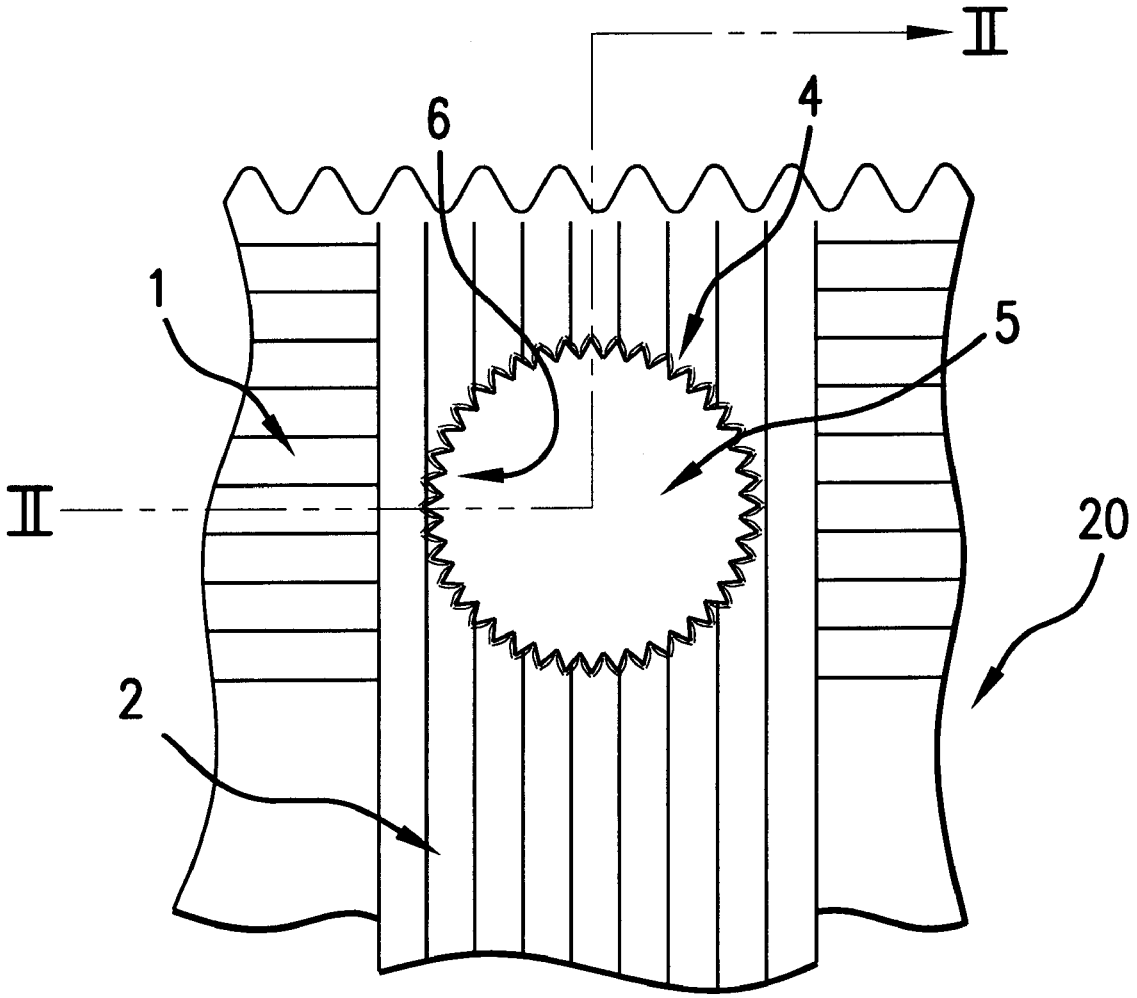
FIG. 3 shows a view of a serrated punch-out in the area of overlap of a cross-seam and a longitudinal seam.
Figure 5:
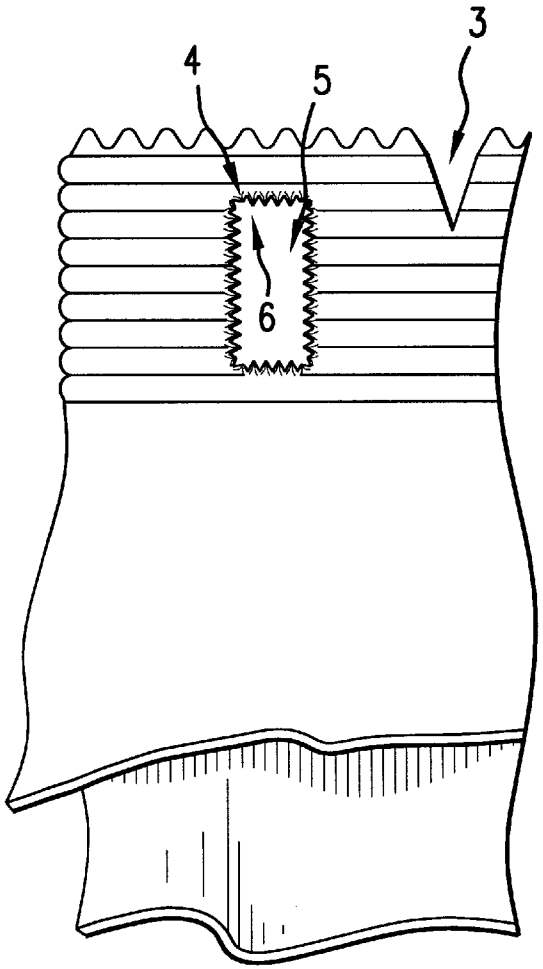
FIG. 5 shows a view of a part of a package with a sealed cross-seam and a notch as well as srtipped shapedl punch-out.
Figure 4:
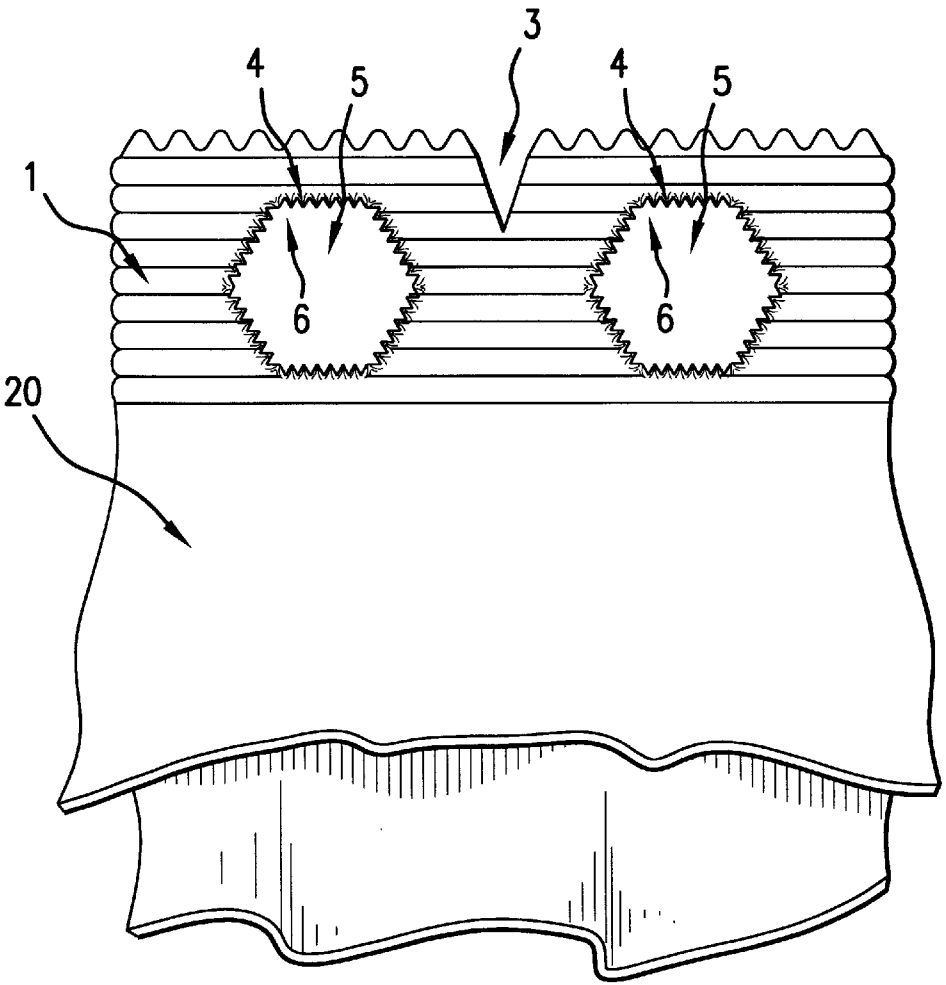
FIG. 4 shows a view of a part of a package with a sealed cross-seam and a notch as well as at least one polygonal punch-out.

FIG. 3 shows a partial view of the package 20 according to the invention with a punch-out 5 in an area of overlap of the sealed cross-seam 1 and a sealed longitudinal seam 2. The serrated contour 6 which is bent forward out of the plane of the seam 2 is clearly discernible. The punch-out has a size which e.g. enables the introduction of a human finger. The size of the punch-out 5 should at least correspond to the tactile surface of a human fingertip. Such a punch-out 5 can be round, but it can also be polygonal or strip-shaped as shown in FIGS. 4 and 5.

All in all, it can be gathered from the drawings and descriptions that the invention is effective, uncomplicated and extremely economical. A slipping-off of the fingers is reliably prevented even when wearing gloves with slippery material adhering to them, so that a package embodied according to the invention can be spontaneously ripped open in a safe and quick manner e.g. in an operating room under the more difficult conditions prevailing therein. Thus, the invention achieves the object indicated above in an ideal way.

What is claimed is:

1. A bag-type package to be torn for easy access to a packaged product comprising at least one sealed seam with a weakening in the form of a notch or groove as a tearing aid, wherein the at least one sealed seam defines at least one aperture as an additional gripping and opening aid disposed next to the weakening, and wherein the at least one aperture has a rim with an at least partially serrated contour.

2. The bag-type package of claim 1, wherein the at least one aperture includes two apertures with rims with the at least partially serrated contour that are assigned to the notch or groove in the at least one sealed seam.

3. The bag-type package of claim 1, further comprising at least one longitudinal seam, the at least one sealed seam and the at least one longitudinal seam overlap and wherein the at least one aperture is provided in an area of the overlap between the at least one sealed seam and the at least one longitudinal seam.

4. The bag-type package of claim 3, wherein the at least partially serrated contour is bent out of a plane of the at least one longitudinal seam and protrudes therefrom.

5. The bag-type package of claim 1, wherein the at least partially serrated contour is at least partially bent out of a plane of the at least one sealed seam and protrudes therefrom.

6. The bag-type package of claim 1, wherein the at least one aperture has a size which enables introduction of a human finger.

7. The bag-type package of claim 1, wherein the at least one aperture has a size which corresponds to a human fingertip.

8. The bag-type package of claim 1, wherein the at least one aperture is round.

9. The bag-type package of claim 1, wherein the at least one aperture is polygonal.

10. The bag-type package of claim 1, wherein the at least one aperture is strip-shaped.

11. The bag-type package of claim 1, wherein the at least one aperture is formed by punching.

12. A package permitting tearing thereof for easy opening comprising:

at least one sealed seam having an edge weakening formed as one of a notch and a groove which functions as a tearing aid;

said at least one sealed seam defines at least one aperture disposed next to the edge weakening; and said at least one aperture has a rim having at least a contoured portion deformed to protrude from a plane of said at least one sealed seam to permit gripping of the rim.

13. The package of claim 12 wherein said contoured portion is serrated.

14. The package of claim 13 wherein said at least one aperture is formed by punching.

15. The package of claim 14, wherein:

the at least one aperture includes two apertures with rims with at least one contoured portion deformed to protrude from the plane of said at least one sealed seam; and the two apertures are respectively disposed adjacement opposing sides of the edge weakening.

16. The package of claim 12, wherein:

the at least one aperture includes two apertures with rims with at least one contoured portion deformed to protrude from the plane of said at least one sealed seam; and the two apertures are respectively disposed adjacement opposing sides of the edge weakening.

17. The package of claim 16 wherein said contoured portion is serrated.

18. The package of claim 16 wherein said at least one aperture is formed by punching.

19. The bag-type package of claim 12, wherein the at least one aperture has a size which enables introduction of a human finger.

20. The bag-type package of claim 12, wherein the at least one aperture has a size which corresponds to a human fingertip.

* * * * *